US009840748B2

(12) United States Patent
Schwartz

(10) Patent No.: US 9,840,748 B2
(45) Date of Patent: Dec. 12, 2017

(54) PROCESS AND FURNACE FOR TREATING WORKPIECES

(75) Inventor: Rolf-Josef Schwartz, Simmerath (DE)

(73) Assignee: Schwartz GmbH, Simmerath (DE)

( * ) Notice: Subject to any disclaimer, the term of this patent is extended or adjusted under 35 U.S.C. 154(b) by 1026 days.

(21) Appl. No.: 13/877,807

(22) PCT Filed: Sep. 29, 2011

(86) PCT No.: PCT/EP2011/066959

§ 371 (c)(1),
(2), (4) Date: Apr. 4, 2013

(87) PCT Pub. No.: WO2012/045647

PCT Pub. Date: Apr. 12, 2012

(65) Prior Publication Data

US 2013/0196275 A1 Aug. 1, 2013

(30) Foreign Application Priority Data

Oct. 5, 2010 (EP) ..... 10186516

(51) Int. Cl.
*B30B 15/34* (2006.01)
*C21D 1/34* (2006.01)
(Continued)

(52) U.S. Cl.
CPC ..... *C21D 1/34* (2013.01); *C21D 1/52* (2013.01); *C21D 1/673* (2013.01); *F27B 17/00* (2013.01); *C21D 9/48* (2013.01)

(58) Field of Classification Search
None
See application file for complete search history.

(56) References Cited

U.S. PATENT DOCUMENTS 2,612,063 A * 9/1952 Wangelin ..... B21J 1/06 225/100
2,710,901 A * 6/1955 Ireland ..... B23K 13/00 219/615
(Continued)

FOREIGN PATENT DOCUMENTS

DE 102004028236 B3 11/2005
FR 2692504 A1 6/1992
(Continued)

OTHER PUBLICATIONS

Japanese Office Action, dated Aug. 17, 2015, for Japanese Patent Application No. JP2013-532132, English translation.
(Continued)

*Primary Examiner* — Gregory A Wilson
(74) *Attorney, Agent, or Firm* — International IP Law Group, PLLC

(57) ABSTRACT

The subject innovation relates to a furnace and a method for treatment of at least one workpiece in the furnace, wherein the workpiece is heated up in a chamber of the furnace by at least two heating units which are each associated with a workpiece having a first side and a second side, and whereby a first heating unit heats up the first side of the workpiece and a second heating unit heats up the second side of the workpiece. Further, each heating unit comprises at least two pressure pistons with heatable contact surfaces that are arranged next to each other and with the same orientation. Contact is made between the first side of the workpiece and the contact surfaces of the first heating unit, and in that contact is likewise made between the second side of the workpiece and the contact surfaces of the second heating unit.

11 Claims, 4 Drawing Sheets

(51) Int. Cl.

| | |
|---|---|
| ***C21D 1/52*** | (2006.01) |
| ***C21D 1/673*** | (2006.01) |
| ***F27B 17/00*** | (2006.01) |
| *C21D 9/48* | (2006.01) |

(56) References Cited

U.S. PATENT DOCUMENTS

| | | | | |
|---|---|---|---|---|
| 2,944,500 | A | 7/1960 | Raynes | |
| 3,095,605 | A * | 7/1963 | Finelt | B22C 7/02 164/45 |
| 3,015,292 | A | 6/1967 | McMillan | |
| 3,461,709 | A | 8/1969 | McMillen | |
| 3,736,783 | A * | 6/1973 | Fabri | B21D 26/025 29/727 |
| 4,888,973 | A | 12/1989 | Comley | |
| 2005/0112384 | A1* | 5/2005 | Bachmann | B30B 15/061 428/447 |
| 2006/0082040 | A1* | 4/2006 | Shimizu | C21D 1/42 269/91 |
| 2009/0074591 | A1* | 3/2009 | Courier | F04B 1/0531 417/59 |
| 2009/0151576 | A1* | 6/2009 | Ito | B29C 51/28 100/305 |
| 2009/0294036 | A1* | 12/2009 | Metzger | B29C 43/12 156/219 |
| 2011/0120640 | A1* | 5/2011 | Laker | B29C 35/0805 156/282 |
| 2011/0283851 | A1* | 11/2011 | Overrath | B21D 22/00 83/15 |
| 2014/0332147 | A1* | 11/2014 | Nakamura | B32B 37/10 156/228 |

FOREIGN PATENT DOCUMENTS

| | | | |
|---|---|---|---|
| JP | H01-156472 | A | 6/1989 |
| JP | 2001179355 | A1 | 7/2001 |
| JP | 2008-130356 | A | 6/2008 |
| JP | 2009-176584 | A | 8/2009 |
| JP | 2010-034423 | A | 2/2010 |

OTHER PUBLICATIONS

International Preliminary Report on Patentability, dated Jan. 17, 2012, for application PCT/EP2011/066959, Filed Apr. 4, 2013, 5 pp. (English Translation).

International Preliminary Report on Patentability, Issued in PCT Application No. PCT/EP2011/066959, dated Jan. 17, 2013, 19 pages. (pp. 1-14 German Translation & pp. 15-19 English Translation).

* cited by examiner

PROCESS AND FURNACE FOR TREATING WORKPIECES

CROSS-REFERENCE TO RELATED APPLICATIONS

Pursuant to 35 U.S.C. §371, this application is the United States National Stage Application of International Patent Application No. PCT/EP2011/066959, filed on Sep. 29, 2011, the contents of which are incorporated by reference as if set forth in their entirety herein, which claims priority to European (EP) Patent Application No. 10186516.0, filed Oct. 5, 2010, the contents of which are incorporated by reference as if set forth in their entirety herein.

In the realm of the production and treatment of formed parts, it is common practice to systematically manufacture formed parts with desired material properties. In the automotive industry, for example, parts such as transverse control arms, B-pillars or bumpers for motor vehicles are hardened in that they are completely heated and subsequently quenched. For this purpose, parts made of steel have to be heated up to at least the austenitization temperature, so that martensite is formed during the rapid cooling. In contrast, parts made of light metal are heated up to the softening temperature. In various application cases, especially in automotive technology, it is advantageous for formed parts to have different material properties in different areas. For example, it can be provided that a part is supposed to have a high strength in one area, but a comparatively higher ductility in another area. This is achieved, for instance, by a different level of heating of the individual areas.

In order to heat up large production quantities of such formed parts, electrically operated furnaces are known nowadays, whereby, in order to heat up a workpiece, for example, an eddy current is induced in the workpiece. In the case of conduction furnaces, however, an electric current is passed directly through the formed part.

Here, however, due to the relatively low heat transfer coefficient (HTC) of 125 $W/m^2/K$ at the maximum, continuous furnaces—even with a multi-layer design—are very long and consume a great deal of energy due to the large surface area. In multi-chamber furnaces, the parts are arranged one above the other, but since these furnaces likewise have a low heat transfer coefficient, they are nevertheless large and have the drawback of entailing high energy consumption.

A heat transfer coefficient of up to 5000 $W/m^2/K$ can be achieved with direct induction heating. However, since the inductive coupling drops drastically above the Curie point in the case of magnetic iron materials and since the induced current flow varies greatly due to the required plate bar geometry—which can have holes as well as widened and narrowed cross sections—the heating is very irregular. Consequently, in order to achieve uniform heating, there is still a need for a conventional furnace. This awkward arrangement is not very practical, unless very simple geometries are involved, but this hardly ever occurs in this realm. Furthermore, induction heating is very expensive, both in terms of investment costs as well as operating costs, due to the requisite secondary energy and the required coil cooling.

Similar drawbacks exist with conduction heating, whereby the operating costs are lower since at least the coil cooling can be dispensed with. However, more sheet metal is needed for a workpiece since the electrode terminals call for contact tabs. Moreover, the two last-mentioned methods do not meet the need for the different structures that then have to be created in a subsequent process step.

In another method, the part is heated up between two heated tools in the form of plates. However, this method has the drawback that, due to the requisite size of the plates, surface deformations and cracks are formed in the plates after a brief operating time, since during each cycle, the permissible elastic deformation of the plates is exceeded by thermal shape changes. The service life of the tools is thus very short, so that the method is very cost-intensive due to the high wear and tear to which the tools are subjected.

Thus, in particular, the prior-art methods are not suited for making formed parts that, partially in a middle area, for example, in the area of the lock case in a B-pillar, have a different structure than in the rest of the formed part and that, at the same time, meet the requirements made in automotive manufacturing in terms of process safety as well as the resultant quality standards, whereby these formed parts allow heating with very high heat transfer coefficients and thus entail low operating costs and extremely low primary energy consumption, thereby avoiding the high wear and tear to which the employed tools are subjected.

SUMMARY

The subject innovation relates to a method for the treatment of at least one workpiece in a furnace, in which method the workpiece is heated up in a chamber of the furnace by at least two heating units, said workpiece having a first side and a second side, and whereby a first heating unit heats up the first side of the workpiece and a second heating unit heats up the second side of the workpiece.

The subject innovation also relates to such a furnace for carrying out the method.

Therefore, the objective of the subject innovation is a method for the treatment of workpieces that allows the formation of such differing material and process properties, while at the same time, meeting the quality standards while only incurring low costs.

Another objective of the subject innovation is to provide such a furnace for carrying out the method.

The subject innovation comprises a method for the treatment of at least one workpiece in a furnace, in which method the workpiece is heated up in a chamber of the furnace by at least two heating units, said workpiece having a first side and a second side. A first heating unit heats up the first side of the workpiece, and a second heating unit heats up the second side of the workpiece. According to the subject innovation, one workpiece is associated with each of the two heating units, and each heating unit has at least two pressure pistons with heated contact surfaces that are arranged next to each other and with the same orientation. The workpiece is heated up in that contact is made between the first side of the workpiece and the contact surfaces of the at least two pressure pistons of the first heating unit, and in that contact is likewise made between the second side of the workpiece and the contact surfaces of the at least two pressure pistons of the second heating unit.

Through this contact heating process, heat transfer coefficients of >2000 $W/m^2/K$ can be achieved, whereby the subject innovation is based on the essential realization that the heating up of a workpiece through contact heating is disadvantageous in the case of a large continuous contact surface since such a contact surface is exposed to pronounced thermal shape changes due to the temperature conditions during use, thus permitting only a certain number of strokes. However, by using a heating unit consisting of at least two pressure pistons having smaller contact surfaces, this negative effect can be avoided and a method can be provided with which the specified requirements can be consistently fulfilled. Here, depending on the size of the workpiece, two pressure pistons per heating unit are the minimum requirement, but more than two pressure pistons have proven to be even more advantageous.

In some embodiments, when the contact surfaces of the pressure pistons of a heating unit make contact with the workpiece, they are each situated in one plane or in different planes, as a result of which flat workpieces with elevations and/or depressions can be contacted.

In order to be able to place a workpiece into a furnace, before the workpiece is heated up, preferably at least two of the pressure pistons are moved vertically, whereby they are moved out of a position without contact between their contact surfaces and the sides of the workpiece, into a position with contact between their contact surfaces and the sides of the workpiece.

In particular, the workpiece is placed horizontally into the furnace chamber and the bottom of the workpiece is laid onto the contact surfaces of the pressure pistons of the lower heating unit. The pressure pistons of the upper heating unit are then moved vertically downward, until contact is made between the contact surfaces of the pressure pistons of the upper heating unit and the top of the workpiece, while the position of the pressure pistons of the lower heating unit is not changed.

If, in order to charge the furnace, a charging device is used that has at least one charging element on which the bottom of the workpiece rests, then it can be provided that the pressure pistons of the lower heating unit that are located in the area of the charging element are moved vertically downward, and that the bottom of the workpiece is subsequently placed onto the contact surfaces of the other pressure pistons of the lower heating unit. The pressure pistons that had previously been moved vertically downward are then moved vertically upward until their contact surfaces make contact with the bottom of the workpiece, and the pressure pistons of the upper heating unit are moved vertically downward until their contact surfaces make contact with the top of the workpiece. This approach ensures that there is sufficient space for the charging device in the furnace chamber during the charging.

For manufacturing reasons, neither the surfaces of the sides of the workpiece nor the contact surfaces of the pressure pistons are completely flat, so that direct contact between the contact surfaces of the pressure pistons and the sides of the workpiece can be interrupted in certain areas; consequently, in order to improve the heat transfer, a thermal fluid is fed into the pressure gap between the sides of the workpiece and the contact surfaces of the pressure pistons. Mechanisms that are integrated into the pressure pistons feed the thermal fluid into the pressure gap in question between the two sides of the workpiece and the contact surfaces of the pressure pistons.

Preferably, the contact surfaces of the pressure pistons are heated up to different temperatures, which allows areas in the workpiece to be heated up to different temperatures. In particular, the contact surface of at least one pressure piston is cooled.

The subject innovation also comprises a furnace for the treatment of at least one workpiece, comprising at least one furnace chamber and at least two heating units for heating up the workpiece in the furnace chamber, said workpiece having a first side and a second side, and the at least two heating units are arranged in such a way that a first side of the workpiece can be heated up by the first heating unit, and the second side of the workpiece can be heated up by the second heating unit. According to the subject innovation, at least two heating units are each associated with a workpiece, and each heating unit comprises at least two pressure pistons with heatable contact surfaces that are arranged next to each other and with the same orientation. The workpiece can be heated up in the furnace chamber in that contact is made between the first side of the workpiece and the contact surfaces of the at least two pressure pistons of the first heating unit, and in that contact is likewise made between the second side of the workpiece and the contact surfaces of the at least two pressure pistons of the second heating unit.

Preferably, at least two of the pressure pistons can be moved vertically, whereby means are provided to move these pressure pistons out of a position without contact between their contact surfaces and the sides of the workpiece, into a position with contact between their contact surfaces and the sides of the workpiece.

Advantageously, the contact surfaces of several pressure pistons of a heating unit arranged in rows and columns each form a heating surface whose dimensions correspond to at least the contours of the workpiece, whereby, when the contact surfaces of the pressure pistons of a heating unit make contact with the workpiece, these contact surfaces can each be arranged in one plane or in different planes. Therefore, with the heating surface formed by the pressure pistons of a heating unit, one side of a workpiece can be contacted virtually completely, whereby, however, it can also be provided that, in the case of uneven workpiece surfaces with elevations and/or depressions, only the horizontal surfaces are contacted, whereby the contact surfaces of the pressure pistons of a heating unit are positioned in different planes in order to achieve this.

In one embodiment, the contact surfaces of the pressure pistons have a honeycomb configuration, since this shape, due to the maximum internal surface area with a minimum external length, has proven to be an advantageous shape while avoiding unheated areas. Preferably, the contact surfaces of the pressure pistons of the first heating unit are arranged offset with respect to the contact surfaces of the pressure pistons of the second heating unit, as a result of which a uniform heating of the workpiece is achieved, while avoiding unheated gaps between the contact surfaces.

In one embodiment, the contact surfaces of the pressure pistons can be heated to different temperatures, which increases the flexibility of use of the furnace, since in this manner, different areas of one workpiece can be heated to different temperatures. It is also advantageous here if at least one pressure piston can be cooled. Therefore, in one embodiment, the contact surface of at least one pressure piston can be selectively heated or cooled.

In order to increase the flexibility of the furnace, at least two of the pressure pistons of a heating unit can be moved vertically selectively.

The above-mentioned and other advantages, special features and practical refinements of the subject innovation are also illustrated on the basis of embodiments which will be described below making reference to the figures.

DETAILED DESCRIPTION OF SPECIFIC EMBODIMENTS

Figure 1:
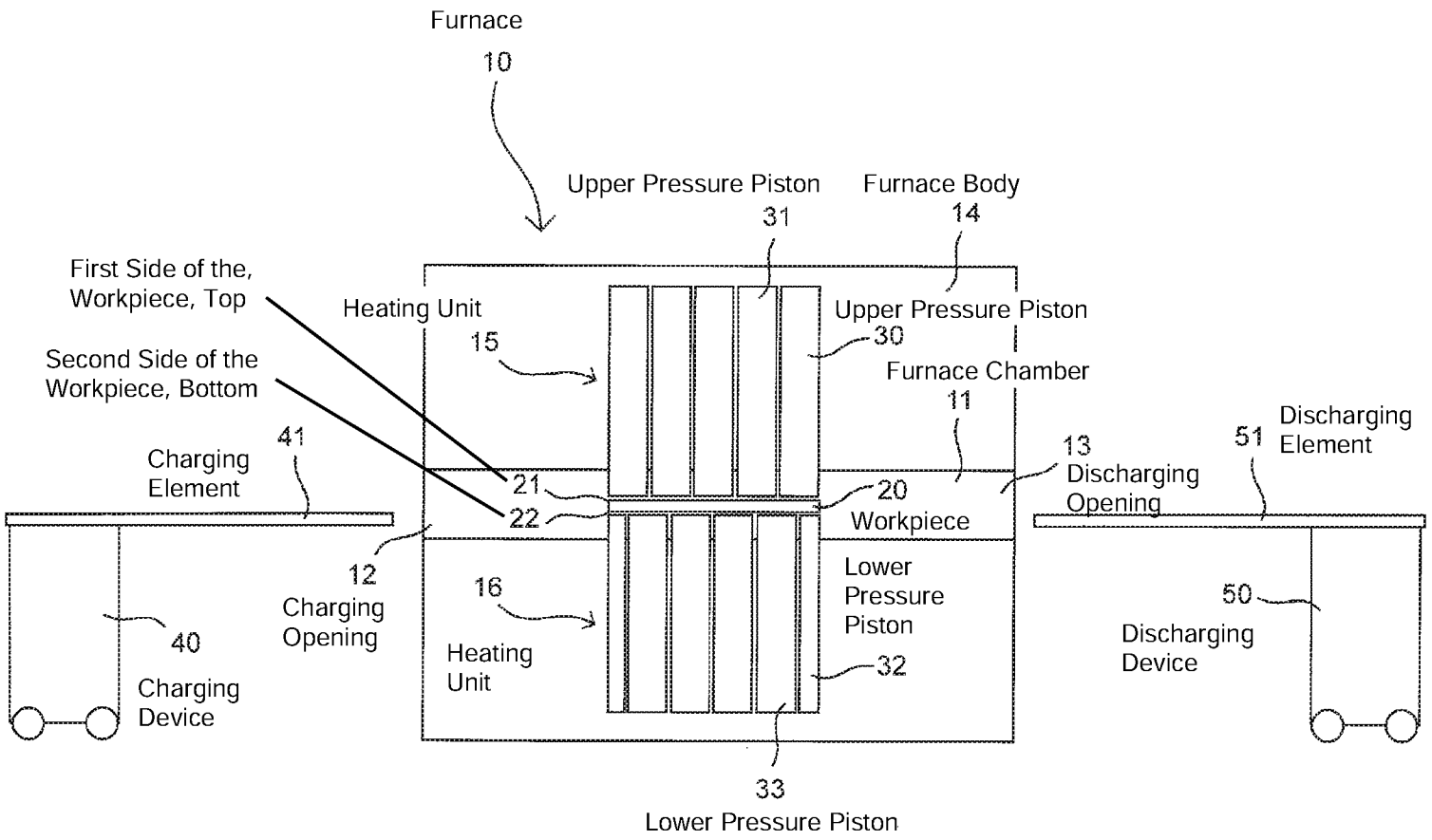
FIG. 1 is a diagram illustrating an embodiment of a furnace with two heating units consisting of several pressure pistons in a schematic side view.

FIG. 1 shows an embodiment of a furnace 10 according to the subject innovation, with two heating units 15 and 16, consisting of several pressure pistons, whereby only the essential features of the furnace are shown. The person skilled in the art can select the furnace details in the usual manner. The furnace 10 shown in FIG. 1 is a furnace with a furnace chamber 11 into which at least one workpiece 20 is placed in order to be heated up. The furnace 10 can be a station in a series of processing stations, whereby the furnace 10 takes over the heating procedure or at least part of the heating procedure. Therefore, the furnace 10 preferably has a furnace body 14 equipped with the furnace chamber 11 having a charging opening 12 and an opposite discharging opening 13, so that the furnace 10 can be charged from one side with a workpiece that is to be heated up, while an already heated workpiece is discharged from the other side. After a heated workpiece has been discharged, it can be transferred, for instance, directly to a press or else kept in a heating channel until it is processed at the next station. However, the furnace 10 does not necessarily have to have two openings, but rather can also have just one opening for charging and discharging.

The charging opening 12 and the discharging opening 13 can be temporarily closed by furnace flaps, and thus a certain gas atmosphere can be generated in the furnace chamber 11.

Preferably, only one workpiece 20 at a time is heated over the length of the furnace 10, so that no workpieces are arranged one after the other, but this is not an absolute requirement if appropriate charging and discharging devices are present that allow several workpieces to be heated up simultaneously. However, several workpieces can also be arranged next to each other over the width of the furnace 10 in order to heat them up simultaneously, or else several furnaces 10 can be operated next to each other, in order to reduce the cycle time for subsequent stations.

In order to charge the furnace 10 with workpieces, a charging device 40, for example, is provided that is used in front of the furnace 10, while a discharging device 50 behind the furnace 10 is used to remove heated workpieces from the furnace 10. For this purpose, both devices have, for instance, a charging element and a discharging element in the form of a fork with which the workpiece can be picked up. The charging device 40 then has, for example, two fork tines 41 and 42, whereas the discharging device 50 has two fork tines. The charging device 40 as well as the discharging device 50 are preferably configured so that they can move horizontally so as to pick up a workpiece 20 on the forks and move it into the opened furnace chamber 11, or they can pick up a workpiece 20 in the furnace 10 and move it out of there. Additionally, the fork tines can also be configured so that they can move vertically. However, any other devices in the form of robots or conveyor belts or combinations thereof can be used as the charging and discharging devices. As an alternative, the possibility also exists to have just one single device for charging and discharging the workpiece 20, said device being used in front of the furnace 10 to place the workpiece 20 into the furnace 10 and also to remove it from there again.

The furnace chamber 11 preferably extends horizontally in the furnace 10 so that the two heating units 15 and 16 are located above and below the workpiece 20 after it has been placed into the furnace 10. Thus, a first side 21 of the workpiece faces upward and can be heated by the upper heating unit 15, while the opposite side 22 of the workpiece is heated by the lower heating unit 16.

Each of the heating units 15 and 16 consists of at least two pressure pistons whose distal end surfaces can be heated. Such a contact surface is on the side of a pressure piston facing the workpiece 20. For the heating procedure, the pressure pistons of both heating units are brought into contact with the workpiece 20 so that the workpiece 20 is heated up by contact heating. In contrast to a solution involving one single large pressure piston per heating unit, a heating unit according to the subject innovation is made up of at least two separate pressure pistons, each having their own contact surfaces. However, the pressure pistons and thus their contact surfaces are arranged so close to each other and oriented in the same direction that a heating surface is created that is virtually continuous. If the workpiece 20 is plate-shaped and is placed into the furnace horizontally, then the contact surfaces of the pressure pistons likewise run horizontally. The distance between the individual contact surfaces of a heating unit is slight, whereby distances of approximately 0.5 mm have proven to be advantageous, which can be considered according to the subject innovation as being a virtually continuous heating surface. The diameter of the contact surfaces is in the order of magnitude of about 50 mm to 150 mm. The actual size of the contact surfaces can be computed from the thermal expansion of the piston material employed as well as from the permissible elastic deformation and the desired service life of the pressure pistons.

Preferably, however, a heating unit consists of more than two pressure pistons, so that, as seen from above, several rows and columns of pressure pistons are formed so that their contact surfaces form a virtually continuous heating surface with which a workpiece can be contacted and thus heated up. In the side view of FIG. 1, for example, five pressure pistons are provided in the front row of the upper heating unit 15, whereby the two right-hand pressure pistons are designated with the reference numerals 30 and 31 by way of example. The front row of the lower heating unit 16, in contrast, comprises six pressure pistons, since, in their horizontal position, they are arranged offset with respect to the pressure pistons of the upper heating unit 15, whereby the two right-hand pressure pistons are designated with the reference numerals 33 and 33, once again by way of example. Due to the offset arrangement, the best possible uniform heating of the workpiece can be achieved. If the pressure pistons were not arranged offset relative to each other, however, disadvantageous temperature gradients could form in the areas between the contact surfaces. Owing to the offset arrangement, however, a gap between the upper pressure piston is always heated by a lower pressure piston and vice versa, resulting in uniform heating.

Preferably, the contact surfaces of the pressure pistons have a honeycomb configuration and are arranged in a heating unit offset with respect to each other in such a way that they form a virtually continuous heating surface. The hexagonal honeycomb shape has the advantage that, like a beehive, it has the maximum internal surface area with a minimum external length, while avoiding unheated areas, and that a surface can thus be filled and tessellated without gaps. Other geometries of the contact surfaces can also be created.

Figure 2:
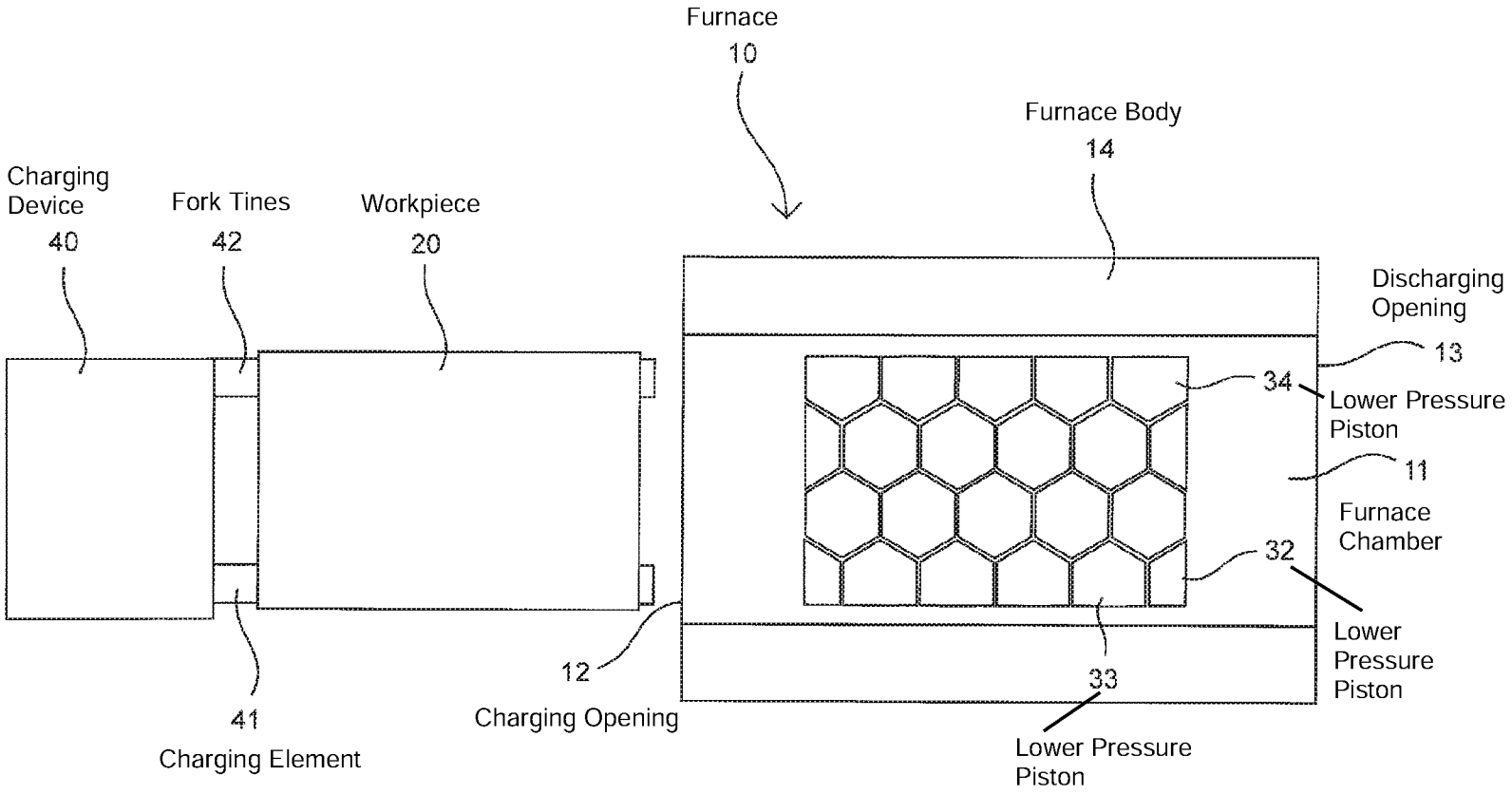
FIG. 2 is a diagram illustrating the furnace according to FIG. 1 in a schematic view with a charging device in front of the furnace.

This honeycomb shape can be seen in the view of FIG. 2, whereby here, a rectangular heating surface is formed by the lower pressure pistons. However, the heating surface can have other shapes as well and can be adapted, for example, to the contours of the workpieces that are to be heated up. Here, a heating surface as set forth in the subject innovation refers not only to a surface that is formed by contact surfaces of the pressure pistons that are all located in one plane, but rather, to contact surfaces located in different planes. The contact surfaces are then all oriented in the same direction—that is to say, advantageously they all extend horizontally—but their vertical position can be different. This can happen when the pressure pistons and thus their contact surfaces are moved differently in the vertical plane. Projected onto a plane, the contact surfaces then form a continuous heating surface, but this heating surface is offset in terms of its height. Nevertheless, this can still be referred to as a heating surface as set forth in the subject innovation, since the contact surfaces can, for example, heat an uneven surface of a workpiece having elevations and/or depressions. Surface sections that do not extend horizontally have no contact with the pressure pistons, but this can at times be accepted or even desired.

As can be seen once again from FIG. 1, the contact surfaces of the pressure pistons of the two heating units 15 and 16 are brought into contact with the workpiece 20 in the furnace chamber 11, so that the workpiece 20 is heated up via both sides 21 and 22 of the workpiece. In order to bring the contact surfaces of the pressure pistons into contact with the workpiece 20, at least two of the pressure pistons are configured so that they can be moved vertically. These can be at least the upper pressure pistons that are configured so that they can be moved vertically, whereas the lower pressure pistons are stationary. Thus, a workpiece can be laid onto the contact surfaces of the lower pressure pistons after the upper pressure pistons have previously been moved upward. As soon as the workpiece has been put in place, the upper pressure pistons are moved downward until they make contact with the workpiece. Here, at least the upper pressure piston can be configured with springs so that they can be lowered vertically further after contact with the workpiece in order to exert a spring pressure onto the top of the workpiece. Which pressure pistons are configured to be movable and which ones are configured with springs depends on the configuration and design of the furnace 10 which, in turn, depends, for instance, on the configuration of the workpieces.

Here, it can be provided that the individual pressure pistons can be actuated separately from each other so that a uniform contact of all of the contact surfaces to the workpiece can be achieved, even if the workpiece has elevations and/or depressions. A selective actuation of individual pressure pistons is also advantageous if the contours of the workpiece to be heated change, so that the shape of the required heating surface, that is to say, the selection of the employed pressure pistons, has to be varied. In this context, it can also be advantageous if individual contact surfaces have special shapes, particularly in the outer areas, so that all of the requisite heating surface formats can be generated by changing the selection of the pressure pistons.

However, since for manufacturing reasons, the surfaces of the workpiece 20 as well as the contact surfaces of the pressure pistons can have minute uneven areas, in spite of the contact between the workpiece 20 and the pressure pistons, small pressure gaps form between the surfaces of the workpiece 20 and the contact surfaces of the pressure pistons, and this would prevent a complete contact fit. Therefore, in order to improve the heat transfer, thin lines are integrated into the pressure pistons via which a thermally conductive fluid can be fed into the pressure gaps that are being formed. The thermal fluid employed can be, for example, monatomic gases such as helium or hydrogen. These gases are characterized by a very high thermal conductivity and thus serve as good heat conductors in the pressure gaps between the contact surfaces of the pressure pistons and the surfaces of the workpiece 20.

So that the linear thermal expansion of the workpiece 20 is possible while it is being heated up in the furnace 10, the method can provide that the movable pressure pistons are pressure-relieved in a selectable clock frequency, after which they are loaded again. During the phases of pressure relief, the workpiece 20 can expand accordingly during the heating procedure, so that a high quality of the treated workpieces can be achieved.

Figure 3:
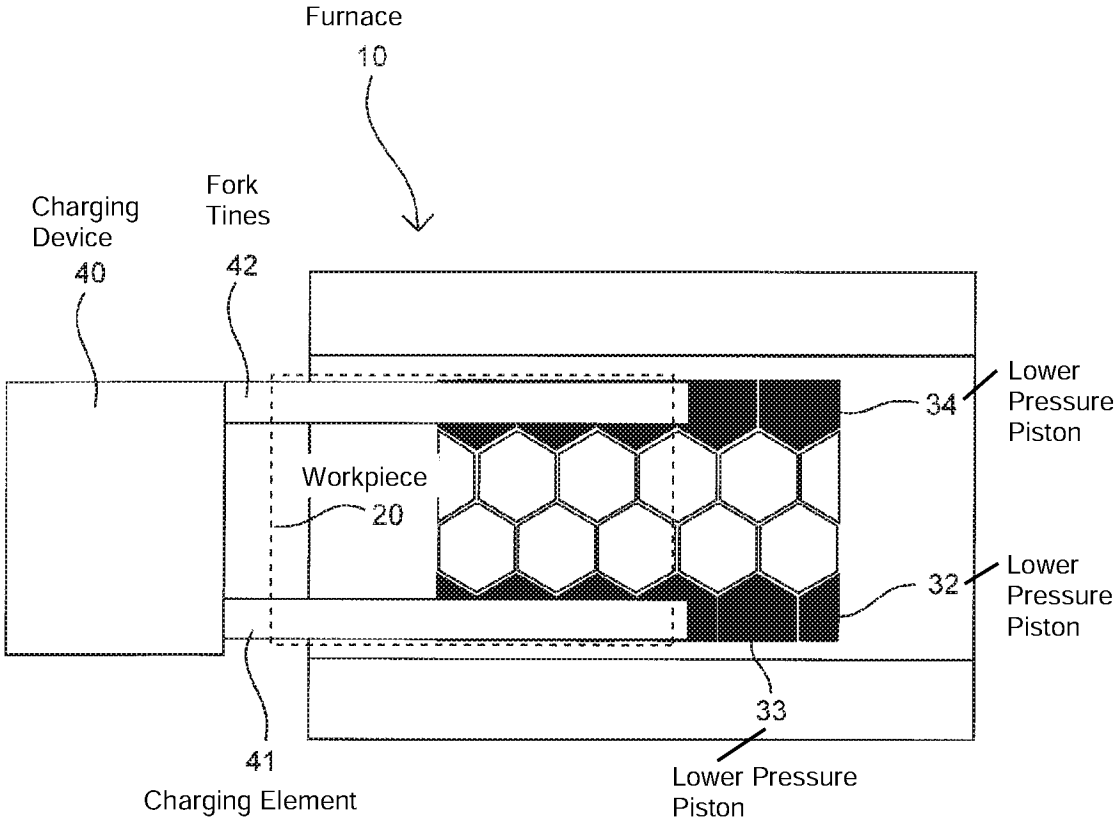
FIG. 3 is a diagram illustrating the furnace according to FIG. 1 in a schematic view while a workpiece is being placed into it via a charging device according to a possible method.

Various methods can be used to charge the furnace 10 with workpieces 20, and the furnace 10 is configured accordingly. As can be seen from FIG. 2, the width of a heating surface formed by the lower pressure pistons (e.g. 32, 33, 34) corresponds approximately to the width of the workpiece 20 that is to be heated up. In order for the charging device 40 to be able to move this workpiece 20 into the furnace chamber 11, the workpiece 20 is picked up by two fork tines 41 and 42 and can then be placed in the furnace chamber 11 onto the lower pressure pistons 32, 33, 34. So that this can be done, one embodiment of the subject innovation provides that the pressure pistons that can be moved vertically downward are those pressure pistons in whose area the fork tines 41 and 42 are located. This is shown schematically in the view of FIG. 3 in which the pressure pistons 32, 33, 34 marked with black were lowered vertically downward with respect to the remaining pressure pistons of this lower heating unit 16. Thus, there is enough space to position the workpiece 20 with the fork tines 41 and 42 above the remaining pressure pistons and to place the workpiece onto them in that the fork tines are moved downward. Subsequently, the fork tines 41 and 42 can be pulled out from under the workpiece 20 so that the latter rests on the contact surfaces of the lower pressure pistons and is in contact with them. Then the upper pressure pistons 30 and 31 that had been previously moved upward can be moved downward until they make contact with the workpiece 20, whereby it is necessary for the heating surfaces to be closed again without large gaps, so that the workpiece can be heated up completely uniformly. After the heating procedure, the workpiece 20 can be analogously removed by the discharging device 50 with the fork tines in the reverse order of the steps.

As an alternative, the furnace chamber 11 can be configured in such a way that there is space elsewhere for the charging and discharging devices 40, 50 to bring the workpiece 20, into a position between the upper and lower pressure pistons. For example, the workpiece 20 can also be slid horizontally into the furnace chamber 11 until it reaches a marking at which the workpiece 20 is oriented in such a way that it is positioned between the pressure pistons of the two heating units. If charging devices are used that can place a workpiece 20 directly onto the lower pressure pistons and can pick it up from there, it might be unnecessary to undertake any additional measures in the furnace 10.

Through the contact of the heated pressure pistons with the workpiece 20, heat transfer coefficients>2000 $W/m^2/K$ can be achieved, as a result of which various heating and cooling strategies are possible. Cycle times of about 6 seconds can be implemented, whereby two furnaces can also be positioned next to each other.

In particular, it is also possible to heat different areas of a workpiece to different temperatures. This is necessary, for instance, if different structures are to be created in different areas of the workpiece, which can be achieved by heating to or below the austenitization temperature. This can be achieved with the subject innovation in that at least some of the pressure pistons can be heated to different temperatures or in that individual pressure pistons can even be cooled. Thus, in one embodiment of the subject innovation, one or more of these pressure pistons can partially heat a defined area of the workpiece to a temperature below that of the austenite formation, while other defined areas are heated to or above the austenitization temperature. In order to reach this state, certain areas can be heated up with fully heated pressure pistons to the austenitization temperature, while other areas are heated up with less heated pressure pistons to a temperature below the austenitization temperature. As an alternative, the workpiece can first be heated completely to or above the austenitization temperature via all of the pressure pistons, after which certain areas of individual pressure pistons are subsequently cooled down to a temperature below the austenitization temperature via individual pressure pistons. This latter embodiment can presuppose that individual pressure pistons are configured so that they can be heated as well as cooled. In both cases, these selected pressure pistons are arranged in such a way that they are located in areas in which a different temperature is to be established. In order to obtain certain shapes for these areas, the contact surfaces of these pressure pistons can also have corresponding contours that differ from those of the other pressure pistons.

The temperature control as well as the vertical movement of the pressure pistons are preferably carried out by a central control unit of the furnace, which is freely programmable.

Figure 4:
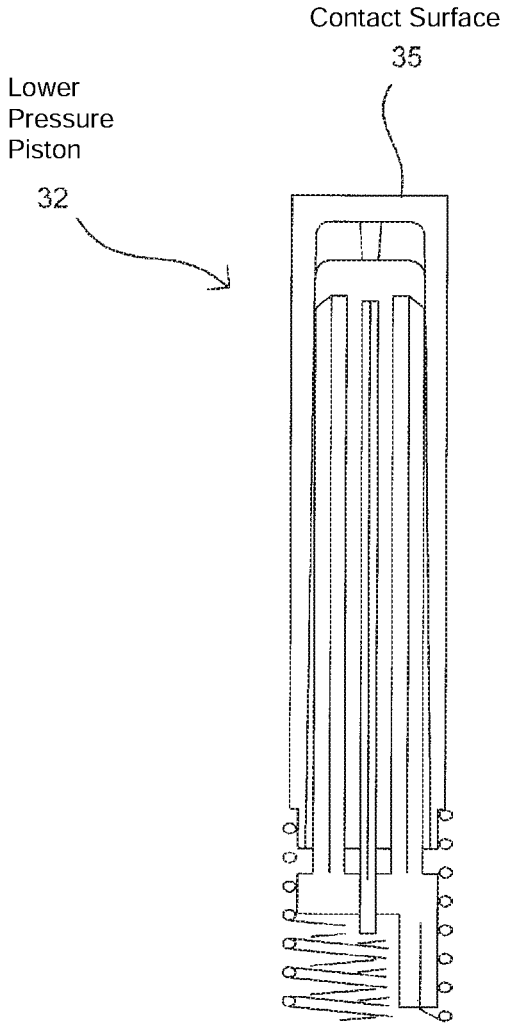
FIG. 4 an embodiment of a pressure piston.

The pressure pistons themselves can be heated by gas or else electrically, whereby electric heating can be carried out, for instance, inductively via a resistor. FIG. 4 shows a possible embodiment of a lower pressure piston 32 with an upper contact surface 35. The pressure piston 32 has a cylindrical configuration and its interior is heated by a gas burner. These gas burners are equipped, for example, with heat exchangers that utilize the heat of the outgoing combustion gases in order to preheat the incoming gases.

In order to permit a fast temperature regulation, the burners are preferably equipped in each pressure piston with a thermal element and external control technology that ensures, for example, a self-ignition temperature of about 800° C. [1472° F.]. In order to safely start up the installation, the furnace chamber 11 has one or more separate intrinsically safe gas burners that preheat the furnace 10 to the self-ignition temperature of the pressure pistons. After this ignition process, the furnace chamber 11 can be filled with conditioned gas since the combustion chamber in each pressure piston is separated from it so as to be gas-tight. Then, for example, inert gas or dried air can be used in the furnace chamber in order to avoid hydrogen embrittlement.

Different materials can be used for the pressure pistons and especially for their contact surfaces, depending on the application case. Suitable options include hot work steel that can be used as alloyed tool steel for application purposes in which the surface temperature can be up to 400° C. [752° F.] during operation. The alloy elements are harmonized with each other in such a way that the hot work steel has sufficient hardness and strength, high-temperature stability, elevated-temperature hardness and wear resistance, even at high temperatures. Therefore, this type of steel is suitable as a material for contact surfaces that are used to heat up workpieces to a temperature of 400° C. [752° F.]. This is the case, for instance, with light metal alloys like aluminum or magnesium workpieces, which are typically heated up to temperatures in the range from 230° C. to 250° C. [446° F. to 482° F.].

In order to heat up workpieces to higher temperatures in the range of 900° C. [1652° F.], which is the case, for example, for boron steel, it is no longer suitable to use hot work steel for the pressure pistons and their contact surfaces, so that, for instance, ceramics can be used for this application area. Advantageously, silicon carbide (SiC) has proven to be a particularly advantageous material for this purpose. If SiC with the typically very high thermal conductance value is selected as the material, this has the advantage that the thermal energy generated inside the pressure piston flows sufficiently quickly through the piston wall/contact surface and can be transferred to the workpiece.

What is claimed is:

1. A method for the treatment of at least one workpiece in a furnace, comprising:

heating the workpiece in a chamber of the furnace, wherein the workpiece comprises a first side and a second side, and wherein a first heating unit heats up the first side of the workpiece and a second heating unit heats up the second side of the workpiece, wherein the first and second heating units are each associated with the workpiece, and wherein each heating unit comprises at least two pressure pistons with heatable contact surfaces that are arranged next to each other and with the same orientation, and wherein the workpiece is heated up in that contact is made between the first side of the workpiece and the contact surfaces of the at least two pressure pistons of the first heating unit, and in that contact is likewise made between the second side of the workpiece and the contact surfaces of the at least two pressure pistons of the second heating unit, wherein when the contact surfaces of the pressure pistons of the first or second heating units make contact with the workpiece, the contact surfaces are arranged in different planes, and wherein the at least two pressure pistons of the first heating unit and at least two pressure pistons of the second heating unit are capable of vertical movement.

2. The method according to claim 1, comprising, before the workpiece is heated up, moving at least two of the pressure pistons of the first or second heating units vertically, whereby the two pressure pistons are moved from a position wherein the contact surfaces are not in contact with sides of the workpiece and into a position wherein the contact surfaces are in contact with the sides of the workpiece.

3. The method according to claim 2, wherein one of the heating units is a lower heating unit and the other heating unit is an upper heating unit, wherein the workpiece is placed horizontally into the furnace chamber and the bottom of the workpiece is laid onto the contact surfaces of the pressure pistons of the lower heating unit, and wherein pressure pistons of the upper heating unit are then moved vertically downward, until contact is made between the contact surfaces of the pressure pistons of the upper heating unit and the top of the workpiece, while the position of the pressure pistons of the lower heating unit is not changed.

4. The method according to claim 3, comprising placing the workpiece into the furnace chamber via a charging device, whereby the charging device has at least one charging element on which the bottom of the workpiece rests, and wherein pressure pistons of the lower heating unit that are located in an area of the charging element are moved vertically downward, and in that the bottom of the workpiece is subsequently placed onto the contact surfaces of the other pressure pistons of the lower heating unit, and in that the pressure pistons of the lower heating unit that had previously been moved vertically downward are then moved vertically upward until their contact surfaces make contact with the bottom of the workpiece, and in that the pressure pistons of the upper heating unit are moved vertically downward until their contact surfaces make contact with the top of the workpiece.

5. The method according to claim 1, wherein the contact surfaces of the pressure pistons of the first and second heating units are heated up to different temperatures, and wherein the contact surface of at least one pressure piston is cooled.

6. A furnace for the treatment of at least one workpiece, comprising:

a furnace chamber; and a first heating unit comprising two pressure pistons;

a second heating unit comprising two pressure pistons, wherein the first and second heating units are to heat up the workpiece in the furnace chamber, the workpiece having a first side and a second side, and wherein the first and second heating units are arranged in such a way that a first side of the workpiece is heated up by the first heating unit, and the second side of the workpiece is heated up by the second heating unit, and wherein the at least two heating units are each associated with the workpiece, wherein the pressure pistons of each heating unit comprises heatable contact surfaces that are arranged next to each other and with the same orientation, and wherein the workpiece can be heated up in the furnace chamber in that contact is made between the first side of the workpiece and the contact surfaces of the pressure pistons of the first heating unit, and wherein the workpiece can be heated up in the furnace chamber in that contact is made between the second side of the workpiece and the contact surfaces of the pressure pistons of the second heating unit, and wherein when the contact surfaces of the pressure pistons of the first or second heating units make contact with the workpiece, the contact surfaces are arranged in different planes and wherein the at least two pressure pistons of the first heating unit and the second heating unit are capable of vertical movement.

7. The furnace according to claim 6, wherein the contact surfaces of the plurality of pressure pistons of the first or second heating units arranged in rows and columns each form a heating surface whose dimensions correspond to at least the contours of the workpiece, whereby, when the contact surfaces of the pressure pistons of the first or second heating units make contact with the workpiece, these contact surfaces can each be arranged in one plane or in different planes.

8. The furnace according to claim 6, wherein the contact surfaces of the pressure pistons of the first and second heating units have a honeycomb configuration.

9. The furnace according to claim 6, characterized in that the contact surfaces of the pressure pistons of the first and second heating units can be heated up to different temperatures.

10. The furnace according to claim 6, wherein the contact surface of at least one of the pressure pistons of the first and second heating units can be heated or cooled selectively.

11. The furnace according to one or more of claim 6, characterized in that at least two of the pressure pistons of the first or second heating units can be moved vertically selectively.

* * * * *